United States Patent [19]

Vercillo

[11] Patent Number: 4,900,211

[45] Date of Patent: Feb. 13, 1990

[54] APPARATUS FOR BINDING MATERIALS USING A CURLED-FINGER RING-TYPE BINDER

[75] Inventor: Alfredo J. Vercillo, Harwood Heights, Ill.

[73] Assignee: General Binding Corporation, Northbrook, Ill.

[21] Appl. No.: 346,919

[22] Filed: May 3, 1989

[51] Int. Cl.[4] ..... B42B 5/08

[52] U.S. Cl. ..... 412/38; 412/33; 412/34; 281/21.1; 281/27.1; 281/28

[58] Field of Search ..... 412/7, 33, 34, 38, 39, 412/40; 281/15.1, 21.1, 27.1, 27.2, 27.3, 28

[56] References Cited

U.S. PATENT DOCUMENTS

| | | | |
|---|---|---|---|
| 1,970,285 | 10/1934 | Dourry | 281/27.1 |
| 2,234,045 | 3/1941 | Emmer | 412/40 |
| 3,433,688 | 3/1969 | Staats et al. | 412/7 |
| 3,793,660 | 2/1974 | Sims | 412/40 |
| 4,645,399 | 2/1987 | Scharer | 83/622 |

*Primary Examiner*—Douglas D. Watts
*Assistant Examiner*—Tom Hamill, Jr.
*Attorney, Agent, or Firm*—Hill, Van Santen, Steadman & Simpson

[57] ABSTRACT

There is disclosed herein an apparatus and method for binding prepunched and apertured materials together with a curled-finger ring-type edge binder using an elongated tool. The tool includes leading, intermediate and trailing sections. The leading section is longer than the binder, but not as wide. The intermediate section which uncurls the fingers taperingly joins the leading and trailing sections. The trailing section is longer and wider than the binder, holds the fingers open, aligns the prepunched paper relative to the fingers and can form an upwardly-facing paper receiving gap. The back end of the trailing section is transverse to the longitudinal axis of the tool for releasing the fingers so as to allow each finger to release its potential energy, extent or snap through the aperture and thus bind the paper together.

8 Claims, 1 Drawing Sheet

APPARATUS FOR BINDING MATERIALS USING A CURLED-FINGER RING-TYPE BINDER

BACKGROUND OF THE INVENTION

This invention relates to ring binders and, more particularly, to curled-finger ring-type plastic binders, a tool and method for binding sheets of materials using the same.

Edge-type binders for use in binding materials, usually sheets of paper together, as in a report or booklet, are known. These binders may be of the plastic curled-finger ring-type which include an elongated spine having curled fingers spaced along the spine and extending from one edge of the spine toward the other edge. One end of the finger is integral with an edge of the spine, and the other finger end is free but resiliently lies against the other spine edge. The diameter or size of the ring is selected in accordance with the quantity of material to be bound. (For example, see U.S. Pat. No. 1,970,285.)

These binders may be opened and closed by a machine in which the binder is mounted to the machine on a comb wherein the spine rests against the comb, and the fingers extend through the spaces between the tines of the comb. L-shaped grasping fingers are provided in the machine which can be extended between the curled fingers, are shifted longitudinally of the spine to engage the fingers and then retracted so as to open the curled fingers by uncurling the same.

Punched paper is then fitted onto the free ends of the uncurled fingers. Sometimes, depending on thickness, the paper to be bound is divided into stacks which are separately fitted onto the curled binder fingers.

The movement of the machine's grasping fingers is reversed and then shifted so as to release the uncurled fingers for return to the spine. In this way the loose pages are bound together. (See, for example, U.S. Pat. Nos. 3,122,761; 3,125,887; 3,227,023; 3,793,660; and 4,645,399.)

This binding machine is generally intended for office use, can be comparatively expensive and sometimes requires electric power. However, some situations do not require this type of binding machine, as for example, binding jobs in the home, small offices, rural settings, etc.

It is therefore an object of this invention to provide a less expensive binding apparatus.

In the past, editing (as distinguished from binding) devices have been provided for use in opening already bound materials so as to add additional material or take away unwanted materials. These devices are of the type shown in German Offenlegungschrift 236240 and German Patentschrift 830 636 are basically rigid, elongated members having a tapered end, are slightly longer than the binder and are wider than the diameter of the curled fingers. These tapered members are inserted into the binder so as to open the curled fingers and permit new pages to be fitted to the opened fingers for binding. The tapered member is then retracted or pulled back and the fingers with the paper thereon close so as to bind the sheets together. While these tapered members are inexpensive, they are disclosed as intended only for editing of existing materials and not for binding new materials together.

It is therefore another object of this invention to provide a device which is suitable for binding new materials together.

These and other objects of this invention shall become apparent from the following description and appended claims.

SUMMARY OF THE INVENTION

There is disclosed herein a binding tool and a method for use of the same in opening a curled-finger ring-type binder so as to bind new materials therewith.

The tool is a flat and elongated member which is flexible in the longitudinal direction, stiff in the transverse direction, and can be twisted about its longitudinal axis. The tool has a leader section, a trailing section and an intermediate or transition section therebetween. The leading section is longer than the binder but has a width less than the diameter of the curled fingers. The trailing section is longer than the binder but wider than the diameter of the curled finger. The intermediate section is tapered and joins the leading and trailing sections. The end or back edge of the trailing section is straight or transverse to the longitudinal axis of the tool for cooperation in closing.

In use, the leading section is fed into the binder, from one end to the other, until the transition section engages the one end of the binder and the frontmost portion of the leading section extends from the other end. The frontmost portion of the leading section is grasped and pulled so as to cause the intermediate section to enter the binder and open the fingers relative to the spine and to cause the trailing end to follow and keep the fingers open. The tool may twist or cause the binder to rotate so as to form an upwardly open gap between the spine and fingers.

The material to be bound is placed in the opened binder and may rest on the trailing section with the prepunched binding apertures and the opened fingers in registry. Then the leading end is pulled axially so as to remove the tool from the binder. As the back end of the tool passes a finger, the energy stored therein is released and the finger snaps or shoots through the aperture as the finger returns to its normal position against the spine.

DESCRIPTION OF THE PREFERRED EMBODIMENT

Figures 1, 2, 3, 4, 5, 6:
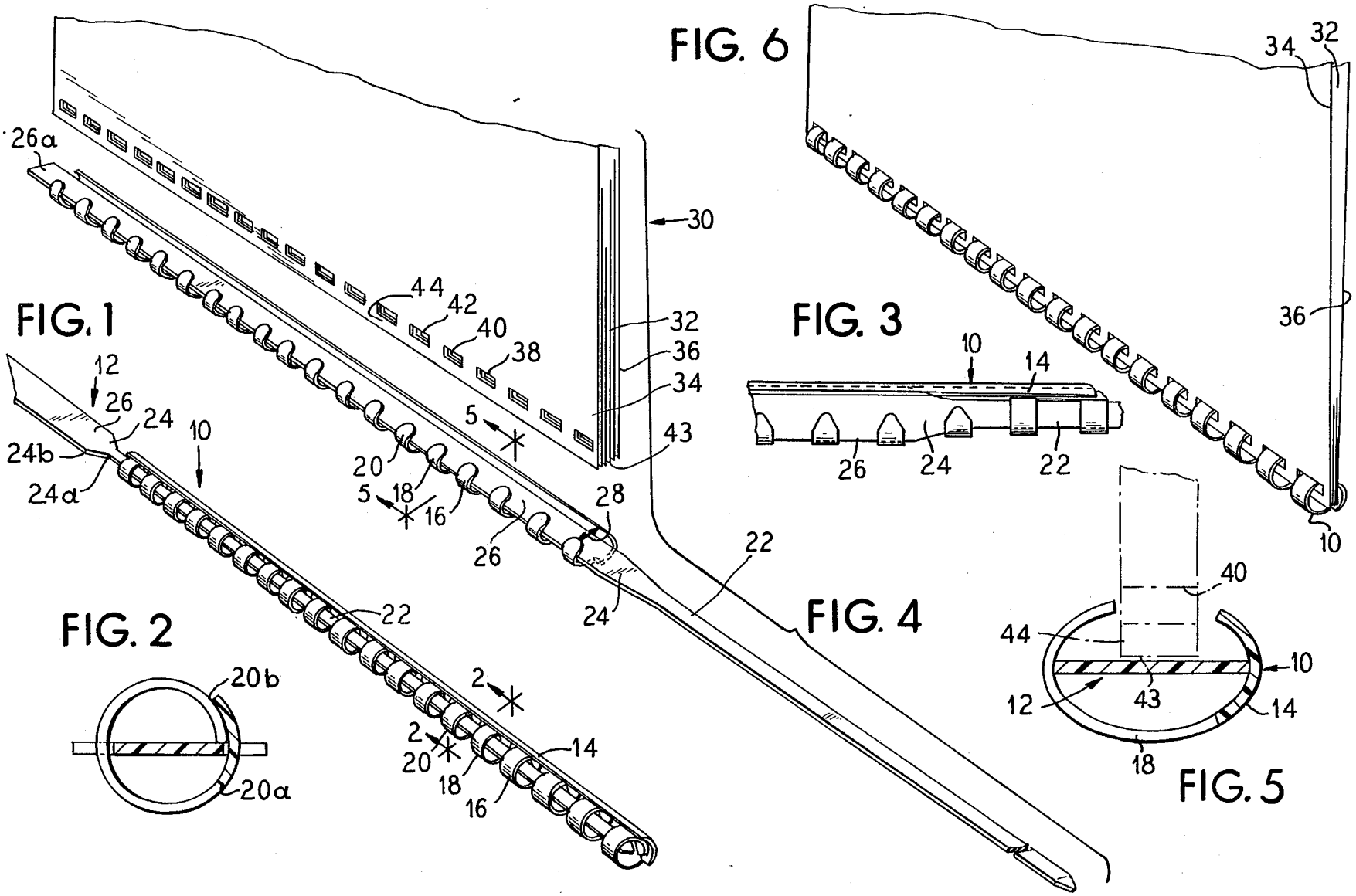
FIG. 1 is a perspective view showing a closed ring binder with the leading end of a tool extending therethrough.
FIG. 2 is a sectional view along line II—II of FIG. 1 showing the binder and tool in section.
FIG. 3 is a fragmentary plan view showing the tool as it is being pulled through the ring binder with some rings being opened.
FIG. 4 is an exploded view showing an opening tool in a fully opened ring binder with punched material, such as paper, positioned to be placed therein.
FIG. 5 is a sectional view generally taken along line V—V of FIG. 4 showing the opened binder, tool and punched material in position to be bound.
FIG. 6 is a perspective view of a bound booklet including the paper and the binder.

Referring now to the drawings, a ring binder 10 generally is shown with the binding tool 12 generally inserted therein. The binder includes a spine 14 along the length of the binder, and a plurality of spaced, curled fingers, such as 16, 18 and 20, along the spine, which extend generally transverse or perpendicular to the spine. Binders for $8\frac{1}{2}\times 11$ paper use nineteen rings and for A-4 paper use twenty rings. Each ring has one end, such as 20*a*, that is integral with one edge of the spine and curls so that the free end, such as 20*b*, rests against the other edge of the spine so as to close the ring.

The tool 12 includes a leading section 22, an intermediate section 24, and a trailing section 26. The leading section 22 is longer than the spine 14, not as wide as the ring diameter, and is tapered at its frontmost end.

The intermediate section 24 tapers from a small end 24*a* integral with the back end of the leading section 22 to a large end 24*b* integral with front end of the trailing section. As seen in FIG. 3, the taper cooperates with the spine and fingers to force the fingers open. The large end 24*b* is wider than the ring diameter.

The trailing section 26 is at least as long as the binder and is wider than the ring diameter so as to hold open uncurled rings whereby a gap 28 is formed between the spine and free ends of the rings. The back end 26*a* of the trailing end is cut straight whereby it is perpendicular to the length of the tool and binder. In this way, when the tool is withdrawn from the binder and the back end of the tool passes a finger, the finger is released. Then the finger resiliently snaps or shoots through a binding aperture in the paper to be bound and closes so as to bind the paper.

As seen in FIG. 5, the tool 12 generally aligns itself along the diameter of the ring binder and generally perpendicular to the direction in which paper is inserted into the binder or in a sense parallel to the gap 28.

The tool is flexible in the longitudinal direction, stiff in the transverse direction and is capable of twisting or rotating about its longitudinal axis so that the tool can assume a least force and maximum opening position, wherein the tool engages the spine and finger of the ring binder. When the tool is pulled horizontally and the binder is in a position where the spine is horizontally arranged along the top and the binder is restrained from moving longitudinally, the spine pivots to a vertical attitude and a horizontal top gap is opened. Thus the rotation opens the binder and forms an upwardly open gap for receiving paper dropped therein. In other words, paper is inserted vertically downwardly and the binder receives the same via the gap in the upper surface.

The material 30 generally to be bound includes paper sheets 32 and covers 34 and 36, which are punched along one side edge to form a series of aligned ring-receiving or binding apertures such as 38, 40 and 42. The size of the aperture (i.e., height, width and depth) is selected to receive the appropriate ring. The position of the aperture or distance, such as 44 between the aperture and page side edge (such as 43), is known as the back gauge. The back gauge distance is selected so that when the page side edge 43 engages the tool 12, as in FIG. 5, the apertures, such as 38, 40 and 42, may be aligned with the free ends of rings such as 16, 18 and 20. Thus as the ring is released, it can snap through the apertured material so as to bind the material 30 with the binder.

A completely bound booklet is shown in FIG. 6 from which the binding tool has been fully withdrawn. The booklet includes the edge or ring binder 10, paper 32 and covers 34 and 36.

In practice, this tool and binder combination have worked successfully in producing thirty-page booklets where various dimensions were as follows:

| | |
|---|---|
| Nominal Ring Diameter | 5/16 inch |
| Tool Trailing Section Width | .562 inch |
| Gap Size | .250–.312 inch |
| Booklet Thickness | .187 inch |
| Back Gauge Distance | .095–.120 inch |

In operation, the leading section 22 of the binding tool 12 is fed into the closed edge binder 10. The tool is pulled into the binder so that the rings are opened by intermediate section 24 and held open by the trailing section 26. The opened fingers form gap 28. Punched paper and covers are then aligned and inserted into the binder via the gap. The papers' side edge may engage the trailing section of the tool and thus align the punched apertures with the free ends of the opened fingers. The tool is then axially pulled out of the binder and as its back end passes each finger, the finger snaps through the aperture and closes the binder. The tool is fully removed and can then discarded or used again and the paper is thus bound into a booklet.

Although the invention has been described with respect to preferred embodiments, it is not to be so limited as changes and modifications can be made which are within the full intended scope of the invention as defined by the appended claims.

I claim:

1. A tool for use in opening a edge-type curled-finger ring-binder having an elongated spine and a plurality of spaced transversely extending binding fingers, each of said fingers having an end integral with one side of the spine and being curled so that the free end thereof can resiliently engage the other edge of the spine, wherein the tool comprises:

a leading section having a length at least as long as a binder spine and a width less than the distance from said spine to an opposed portion of a finger;

a trailing section having a length at least as long as a binder spine and a width greater than the distance between said spine and an opposed portion of a finger;

an intermediate section for joining said leading section and trailing section;

whereby when said tool is axially pulled through said binder, the finger free ends are spread from said spine so as to permit binding of apertured sheets.

2. A tool as in claim 1, wherein said intermediate section is tapered so as to join that leading and trailing sections and cooperate in opening said fingers.

3. A tool as in claim 1, wherein the trailing section includes means defining a back edge which is substantially transverse to the longitudinal axis of the tool for releasing each finger from an open position for return to a closed position.

4. A tool as in claim 1, wherein said tool is longitudinally flexible, transversely stiff, and pivotable about its longitudinal axis for cooperation in opening said fingers in defining a binding gap between the spine and free end of an opened finger.

5. A tool as in claim 1, wherein the trailing section is constructed to cooperate with apertured sheets to be bound and ring binder in aligning apertures of sheets relative to free ends of binder fingers.

6. A tool as in claim 5, wherein the distance between an aperture and an adjacent edge of a sheet is known as the back gauge and the tool is constructed so that said finger free end is positioned above the tool a distance greater than the back gauge and aligned with the aperture.

7. In combination, a ring binder and a tool for opening said ring binder comprising:

an edge-type curled-finger ring-binder having:

an elongated spine; and a plurality of spaced transversely extending binding fingers, each of said fingers having an end integral with one side of the spine and being curled so that the free end thereof can resiliently engage the other edge of the spine; and a tool for use in opening said ring binder having:

a leading section having a length at least as long as the binder spine and a width less than the distance from said spine to an opposed portion of a finger;

a trailing section having a length at least as long as the binder spine and a width greater than the distance between said spine and an opposed portion of a finger; and an intermediate section for joining said leading section and trailing section;

whereby when said tool is axially pulled through said binder, the finger free ends are spread so as to permit binding of apertured sheets.

8. A combination as in claim 7, wherein said tool leading section is initially positioned within said binder so that the frontmost end of the tool extends from an end of the binder.

* * * * *